United States Patent [19]

Irwin

[11] Patent Number: 4,781,380

[45] Date of Patent: Nov. 1, 1988

[54] ARTICULATED RING PUZZLE

[76] Inventor: Thomas J. Irwin, P.O. Box 7710, Atlanta, Ga. 30357-0710

[21] Appl. No.: 114,645

[22] Filed: Oct. 28, 1987

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,441,715 4/1984 Titus ..... 273/153 S

FOREIGN PATENT DOCUMENTS 2501516 9/1982 France ..... 273/153 S 210427 6/1984 German Democratic Rep. ..... 273/153 S 1138180 2/1985 U.S.S.R. ..... 273/153 S WO83/01203 4/1983 World Int. Prop. O. ..... 273/153 S

*Primary Examiner*—Anton O. Oechsle

*Attorney, Agent, or Firm*—Jones, Askew & Lunsford

[57] ABSTRACT

A multi-component puzzle comprised of ring-forming components which are rotatable about selected orthogonally related axes to move individual components into various relationships. The components are co-acting and constrained to move about each other without the need for a central framework. The absence of a central framework permits a variety of puzzle forms, including intersecting rings, lattices, cubes and combinations of these forms.

12 Claims, 8 Drawing Sheets

ARTICULATED RING PUZZLE

TECHNICAL FIELD

The present invention relates generally to three-dimensional manipulatable puzzle devices, and relates particularly to an improved articulated puzzle device with ring-forming components which are rotatable about selected orthogonally related axes to move individual components into various relationships.

BACKGROUND OF THE INVENTION

Various three-dimensional manipulatable toys and puzzles are known. A popular device which has sold under the trademark "Rubik's Cube" is a puzzle cube, each of whose six faces appears to be a 3×3 array of subcubes. The elements comprising each face can rotate about an axis perpendicular to that face. By a sequence of rotations of the various faces, individual elements can be moved from one face to another face of the main puzzle cube. In this manner, the puzzle can be manipulated into some predetermined arrangement of the subcubes, specified for example by the colors on the faces of the subcubes. However, in the Rubik puzzle, the center subcube of each face is attached to the axis of rotation for that face, preventing movement of the center subcube to another face. Indeed, the six axes of rotation intersect at the center of the main cube, and, together with each face's center subcube element, form a central framework about which all other puzzle elements rotate. This method of constructing a manipulatable puzzle limits the types of arrangements that can be achieved.

A number of variations and generalizations of the Rubik puzzle have been described. U.S. Pat. No. 4,432,548 describes a cubic block puzzle, related to the Rubik puzzle, wherein the center subcube of each face can be moved to other faces. This puzzle is constructed with a central cage about which the individual puzzle elements can move. Although the cage construction permits more general manipulation of the puzzle elements, the puzzle is still limited to a cubic array of elements, moving about a central framework.

Other puzzles are configured in 4×4×4 arrays (e.g., as described in U.S. Pat. Nos. 4,421,311 and 4,511,144) or 2×2×2 arrays (e.g., as described in U.S. Pat. Nos. 3,655,201 and 4,405,131), but all of these puzzles are also constructed with a central framework of some type. Still other three-dimensional puzzles are not restricted to cubic appearances (e.g., as described in U.S. Pat. Nos. 3,081,089, 4,344,623, 4,461,480, 4,473,228, and 4,478,418), but nevertheless are constructed with a central structure about which the puzzle elements move.

The presence of a central framework or structure in all of the previously-known puzzles not only limits the types of arrangements which can be achieved with a given puzzle, but also limits the overall appearance of the puzzle to closed, three-dimensional solids or lattice structures such as the central framework permits.

SUMMARY OF THE INVENTION

Briefly described, the apparatus of the present invention is comprised of various numbers of co-acting components which are constrained to move about each other without the need for a central framework. The absence of a central framework permits the assembly of a puzzle in the form of a series of intersecting articulated rings, each comprised of a number of ring segments. The ring-forming components can move from ring to ring at the points of intersection.

More particularly described, the puzzle is made up of a plurality of identical edge components, a plurality of identical center components, and a plurality of identical corner components. The edge components have two parallel sides and two orthogonal sides. The center components have two sets of two parallel sides. The corner components have three orthogonal sides. When assembled, the components form a number of rings. Means are provided so that the components are constrained to move along the rings during operation of the puzzle.

The puzzle may be alternatively assembled of the edge and center components alone, or of the edge and coner components alone. In the first alternate construction, any number from one up to the total number of corner components can be selectively added to the structure without affecting the operability of the puzzle as a whole. Similarly, in the second alternative construction, any number from one up to the total number of center components can be selectively added to the overall structure without affecting its operation.

The operation of the invention is enabled by guiding path segments aligned with the various sides of the components so as to guide the movement of adjacent components. The adjacent components are constrained to follow the guiding path segments by moving or sliding along them, the constraint being furnished by complementary path segments which intermesh with the guiding path segments. The guiding path segment may be a guiding track which resides in one of two adjacent components, and the complementary path segment may be a track follower which resides in the other adjacent component.

To facilitate assembly and disassembly of the puzzle, the components may have additional path segments or tracks which are used only during assembly of the puzzle. Switches or locks additionally may be furnished to either disengage the assembly paths from the guiding paths employed during normal operation or retain certain components as necessary so as to prevent the puzzle from inadvertently disassembling during operation.

The invention may be configured so that its appearance is that of a number of orthogonal rings, intersecting in a manner so as to form a lattice in the general shape of a sphere. Alternately, by suitably shaping the ring-forming components, the invention can be configured so that each component has a cubic solid appearance. When thusly constructed the assembled cubic solid puzzle has the overall shape of a larger cube. The cubic components are rotatable in the plane of each face of the larger cube. These rotations are similar to those of the Rubik puzzle, but are enabled by the guiding tracks rather than by a central framework. Also unlike the Rubik puzzle, the cubic form of the puzzle can be operated either with or without the corner cubic components and either with or without the center cubic components, as described above.

As yet another variation, the cubic variation can be formed so that its appearance is that of a lattice or a grid, rather than that of a solid cubic structure. Furthermore, the sphere-forming components, the cubic solid components, and cubic lattice components can be interchanged for various mixed puzzle types.

It can be seen, therefore, that the present invention has been designed to permit great flexibility in the shape of puzzle components and in the overall configuration of the assembled puzzle. The invention permits cubic and other closed forms as well as open structures such as intersecting rings and cubic lattices.

An object of the present invention is to construct a pleasing and easily operable puzzle toy with a plurality of movable parts.

A further object of the invention is to provide a puzzle which is in the form of intersecting rings having movable segments.

Another object is to provide a puzzle which is easy to construct and which can be disassembled and reassembled in a variety of configurations.

Other objects, features and advantages of the present invention will become apparent upon reading the following specification when taken in conjunction with the drawings and the appended claims.

DETAILED DESCRIPTION OF THE PREFERRED EMBODIMENTS

Figure 1:
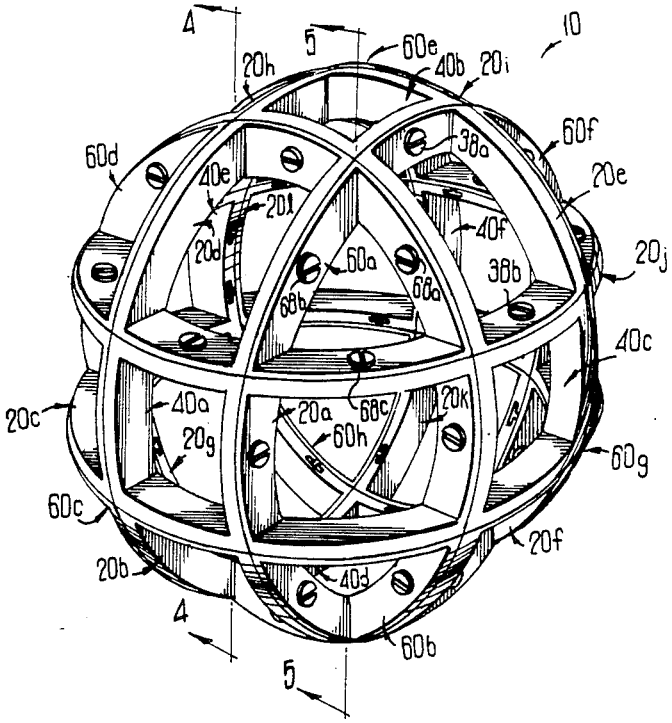
FIG. 1 is an perspective view showing a ring embodiment of the present invention.

Referring now in more detail to the drawings, in which like numerals indicate like elements throughout the several views, FIG. 1 depicts a ring-shaped embodiment of the present invention wherein twelve edge components 20*a*, 20*b*, . . . , 20*l*, six center components 40*a*, 40*b*, . . . , 40*f* and eight corner components 60*a*, 60*b*, . . . , 60*h* are assembled to form a toy ring puzzle 10. FIG. 1 also shows retaining screws 38*a*, 38*b*, 68*a*, 68*b* and 68*c* which are the means to ensure that the puzzle does not inadvertently disassemble during operation. In the ring embodiment, the edge components are also called rectangular components because of their rectangular appearance. Similarly, the center components are also called square components and the corner components are called triangular components.

In the assembled ring puzzle 10, the components form three pair of rings, each pair of rings being parallel and mutually orthogonal to each of the other two pair. The three pair of rings are configured to intersect in such a manner as to form a lattice work in the general appearance of a sphere. Each ring is split in the plane of the ring into two halves which slidably rotate with respect to each other. With respect to the inside and the outside of the sphere, the corner and edge components form the outside halves of the rings and the center and edge components form the inside halves of the rings. Each center and edge component forms a portion of four different rings, and each corner component forms a portion of three different rings.

In the operation of the ring puzzle 10, the components may be cooperatively moved so that any one edge component may take the place of any other edge component in the structure, any center component may take the place of any other center component of the structure, and any corner component may take the place of any other corner component in the structure.

Figure 8:
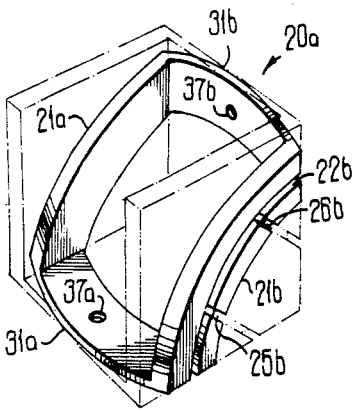
FIGS. 8 and 9 are fragmentary perspective views showing by phantom lines the relationship between a rectangular ring component of FIG. 1 and an edge cubic component of FIG. 12.
Figure 9:
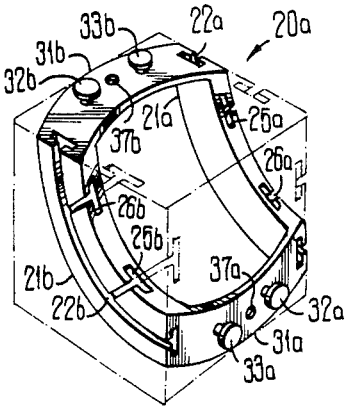

Each edge component is of four-sided rectangular construction in the form depicted in FIGS. 8 and 9. Two of the sides 21*a* and 21*b* are parallel. A third side 31*a* is perpendicular to the two parallel sides 21*a* and 21*b* and a fourth side 31*b* is perpendicular to both the third side 31*a* and the two parallel sides 21*a* and 21*b*. Each of the sides is a flat plate, nominally of rectangular cross-section, partially bounded in the plane of the plate by semi-circular arcs whose radii of curvature extend from the arc in question to the common center 11 of the rings formed by the assembled puzzle and as depicted, for example, in FIG. 4. The arcs are bounded at opposite ends by lines which are parallel in the case of the third and fourth orthogonal sides 31*a* and 31*b* and by lines which are perpendicular in the case of the parallel sides 21*a* and 21*b*.

Each parallel side 21*a* and 21*b* of each edge component has a path segment in the form of a guiding tack 22*a* and 22*b*, respectively, embedded in the component and traversing its length. In the preferred embodiment, the track is a T-shaped channel when viewed in cross-section and a semi-circular arc when viewed in a direction normal to the plane of the plate, as shown, for example, in FIG. 5. The radius of curvature of the channel extends from the arc to the center 11 of the rings of FIG. 5. The narrow portion of the T-shaped channel forms an opening which describes a semi-circle in the outer surface of each parallel side, the outer surface being the side away from the center 11 of the sphere formed by the rings of FIG. 1.

Each inner surface of each orthogonal side 31*a* and 31*b* of each edge component has a complementary path segment in the form of two flange-shaped studs 32*a*, 33*a*, 32*b* and 33*b* protruding from the surface at points along an arc of the same radius of curvature as that of the guiding tracks 22*a* and 22*b*. These studs engage tracks 22*a* and 22*b* of adjacent edge components, and similar tracks 42*a*, 42*b*, 42*c*, and 42*d* of adjacent center components during the operation of the puzzle, as will be described below.

Figure 10:
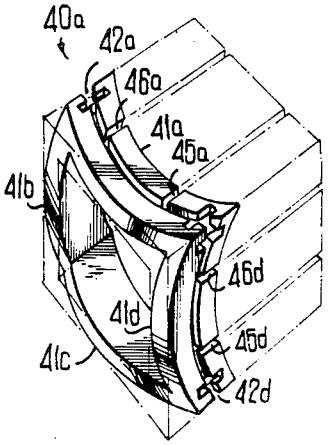
FIGS. 10 and 11 are fragmentry perspective views showing by phantom lines the relationship between a square ring component of FIG. 1 and a center cubic component of FIG. 12.
Figure 11:
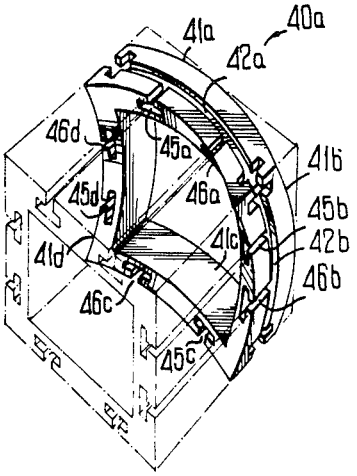

Each center component is of four-sided square construction in the form depicted in FIGS. 10 and 11. Two of the sides 41*a* and 41*c* are parallel. The other two sides 41*b* and 41*d* are parallel and perpendicular to the first two sides 41*a* and 41*c*. Each of the sides is a flat plate, nominally of rectangular cross-section, and partially bounded in the plane of the plate by semi-circular arcs whose radii of curvature extend from the arc in question to the common center 11 of the rings formed by the assembled puzzle, and as depicted, for example, in FIG. 4. For each of the four sides, the arcs are bounded at opposite ends by lines which are parallel.

Each side 41*a*, 41*b*, 41*c*, and 41*d* of each center component has a path segment in the form of a guiding track 42*a*, 42*b*, 42*c*, and 42*d*, respectively, embedded in the component and traversing its length. In the preferred embodiment, the track is a T-shaped channel when viewed in cross-section and a semi-circular arc when viewed in a direction normal to the plane of the plate, as shown, for example, in FIG. 5. The radius of curvature of the channel extends from the arc to the center 11 of the rings of FIG. 5. The narrow portion of the T-shaped channel forms an opening which describes a semi-circle in the outer surface of each parallel side, the outer surface being the side away from the center 11 of the sphere formed by the rings of FIG. 1.

The guiding tracks 42*a*, 42*b*, 42*c*, and 42*d* are designed to guide the flange-shaped studs 32*a*, 33*a*, 32*b*, and 33*b* of adjacent edge components, and similar studs 62*a*, 63*a*, 62*b*, 63*b*, 62*c*, and 63*c* of adjacent corner components, during operation of the puzzle, as will be described below.

Figure 6:
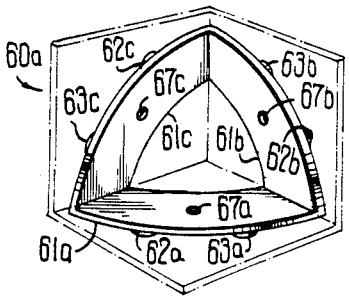
FIGS. 6 and 7 are fragmentary perspective views showing by phantom lines the relationship between a triangular ring component of FIG. 1 and a corner cubic component of FIG. 12.
Figure 7:
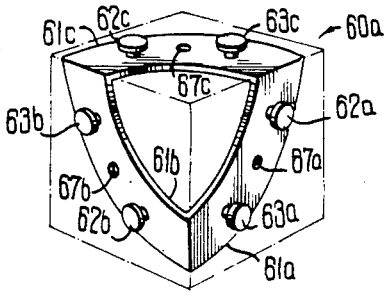

Each corner component is of three-sided triangular construction in the form depicted in FIGS. 6 and 7. Each of the sides 61*a*, 61*b*, and 61*c* is mutually perpendicular to both of the other two sides. Each of the sides is a flat plate, nominally of rectangular cross-section, partially bounded in the plane of the plate by semi-circular arcs whose radii of curvature extend from the arc in question to the common center 11 of the rings formed by the assembled puzzle and as depicted, for example, in FIG. 4. The arcs are bounded at opposite ends by lines which are perpendicular.

Each inner surface of each side 61*a*, 61*b*, and 61*c* of each corner component has a complementary path segment in the form of two flange-shaped studs 62*a* and 63*a*, 62*b* and 63*b*, and 62*c* and 63*c*, respectively, protruding from the surface at points along an arc of the same radius of curvature as that of the guiding tracks 22*a*, 22*b*, 42*a*, 42*b*, 42*c*, and 42*d*. These studs engage the guiding tracks in adjacent center and edge components during operation of the puzzle, as will be described below.

When all of the edge, center and corner components are assembled as shown in FIG. 1, is can be appreciated that the four edge components 20*a*, 20*b*, 20*c*, and 20*d* and four corner components 60*a*, 60*b*, 60*c*, and 60*d* disposed about a single center component 40*a* may be rotated as a group around and with the center component, without moving the remaining components of the puzzle. During this rotation, the studs of the moving edge and corner components engage and are guided by the guiding tracks of the adjacent unmoving center and edge components. This type of rotation, with a different group of edge and corner components, may be performed about any of the six center components 40*a*, 40*b*, 40*c*, . . . , and 40*f* in the puzzle.

Figure 4:
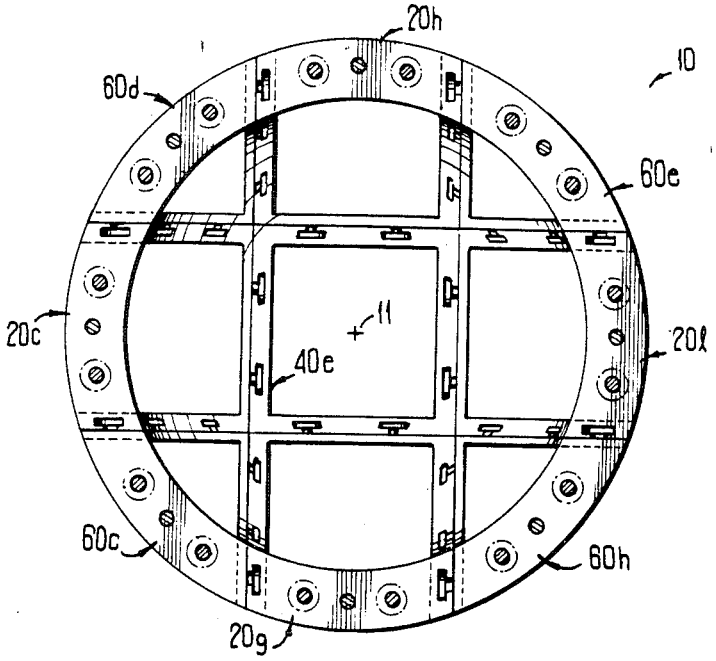
FIG. 4 is a cross-sectional view made by a plane cut at line 4—4 in FIG. 1.

Further details of the construction of the entire ring puzzle 10 are shown in FIG. 4, which is a cross-section of the ring puzzle 10 in FIG. 1 taken at a cut line 4—4. The cut line cuts away the corner components and edge components adjacent to center component 40*e*. The resulting cross-section shows the alignment of the flange-shaped studs in these adjacent corner and edge components to form a circular path.

Figure 5:
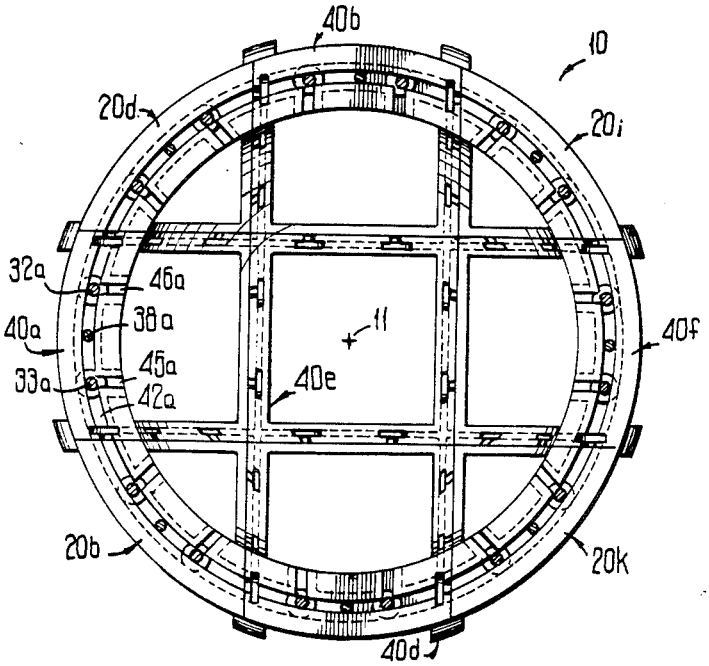
FIG. 5 is a cross-sectional view made by a plane cut at line 5—5 in FIG. 1.

FIG. 5 is a cross-sectional view formed by cutting the ring puzzle 10 of FIG. 1 at the cut line 5—5 and depicts adjacent center and edge components deployed about the void puzzle center. This view also shows the alignment of the various guiding tracks in these adjacent center and edge components to form a circular path.

Figure 12:
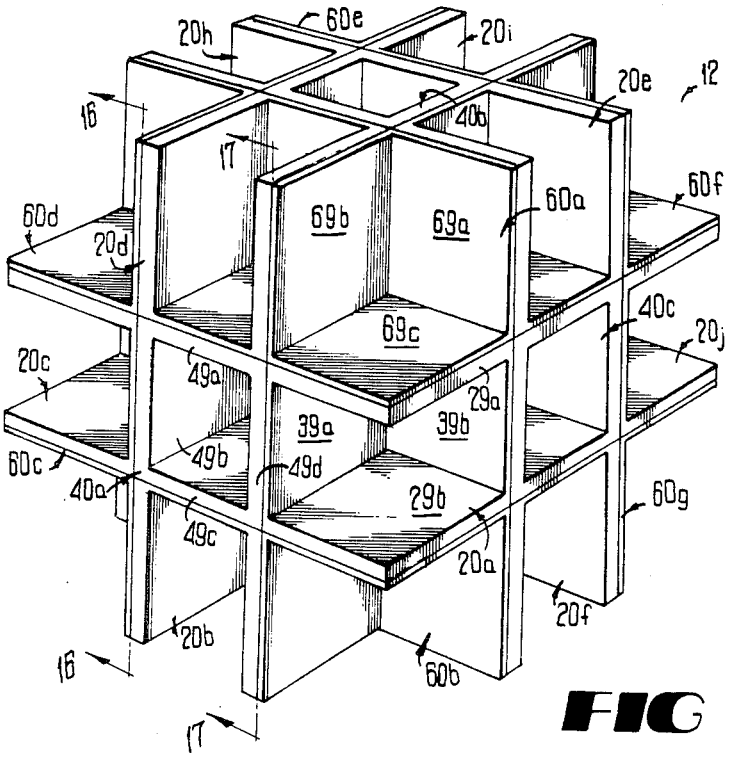
FIG. 12 is an perspective view of the present invention in a cubic lattice embodiment.

As shown in FIGS. 6 through 11 by phantom lines, nonfunctional structure may be added to each of the edge, center, and corner components so as to provide a puzzle of cubic lattice-like appearance, as shown in FIG. 12. As shown in FIGS. 6 through 11, each side of each component of the cubic lattice puzzle 12 is a flat square plate, rather than a flat plate of semi-circular shape as is the case for the ring puzzle 10. The corner component is made of three such plates 69*a*, 69*b*, and 69*c*, each of which is mutually orthogonal to the other two. The edge component is made of four such plates, where two of the plates 29*a* and 29*b* are parallel and are joined by two other plates 39*a* and 39*b* which are perpendicular. Finally, the center component is made of four plates, two of which 49*a* and 49*c* are parallel and which are joined by two other plates 49*b* and 49*d* which are also parallel and perpendicular to the first two.

Figure 13:
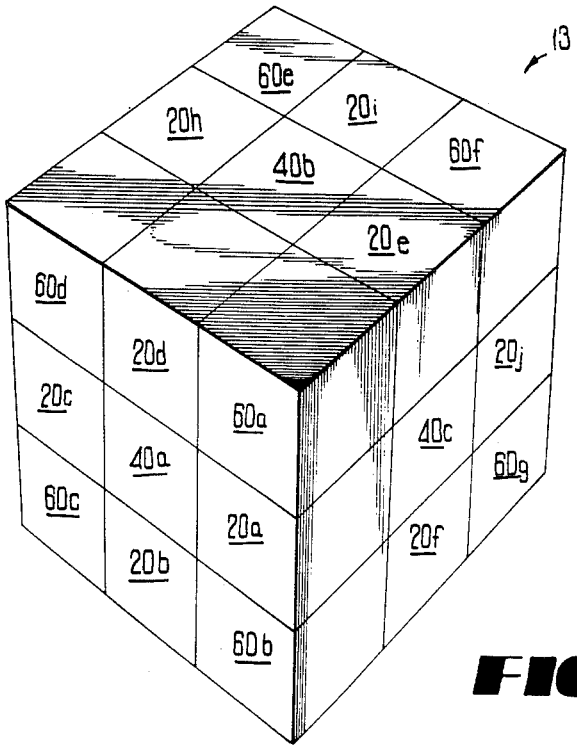
FIG. 13 is an perspective view of the present invention in a cubic solid embodiment.

As shown in FIG. 13, further non-functional structure can be added to each component, so that each component has a cubic solid appearance. When thusly constructed, the assembled cubic solid puzzle 13 has the overall shape of a large cube. The cubic components are rotatable in the plane of each face of the large cube. These rotations are similar to those of Rubik puzzle, but are enabled by the circular guiding tracks rather than by a central framework.

Figure 14:
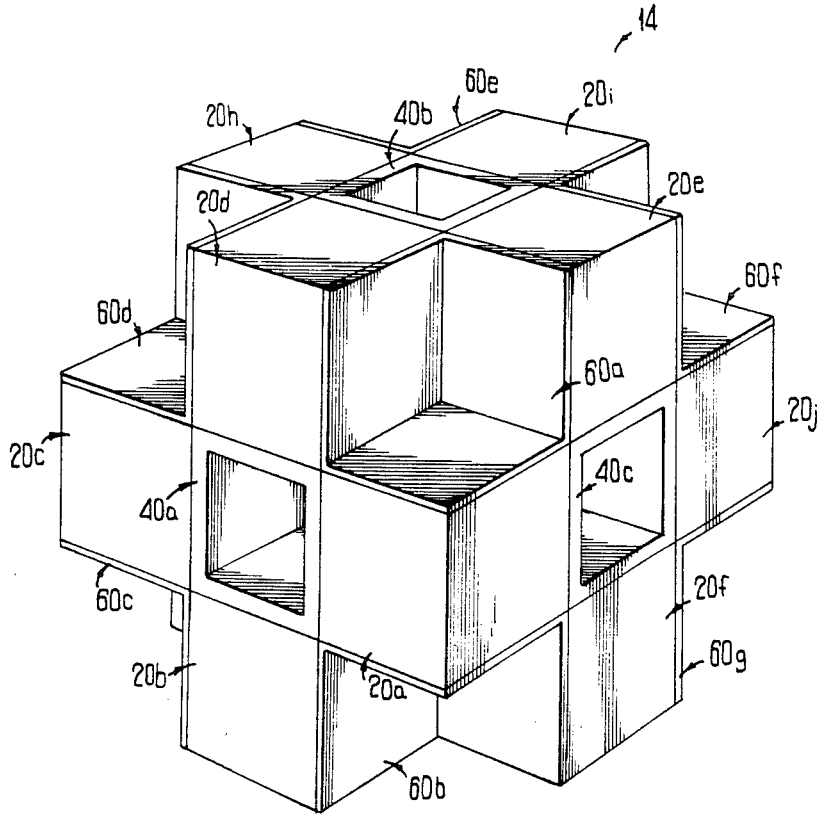
FIG. 14 is an perspective view of the present invention in an embodiment constructed partially of cubic lattic componenets and partially of cubic solid components.

Another variation of the present invention is shown by the cubic mixed puzzle 14 in FIG. 14, where the edge components have a cubic solid structure, and the center and corner components have a cubic lattice structure.

Figure 16:
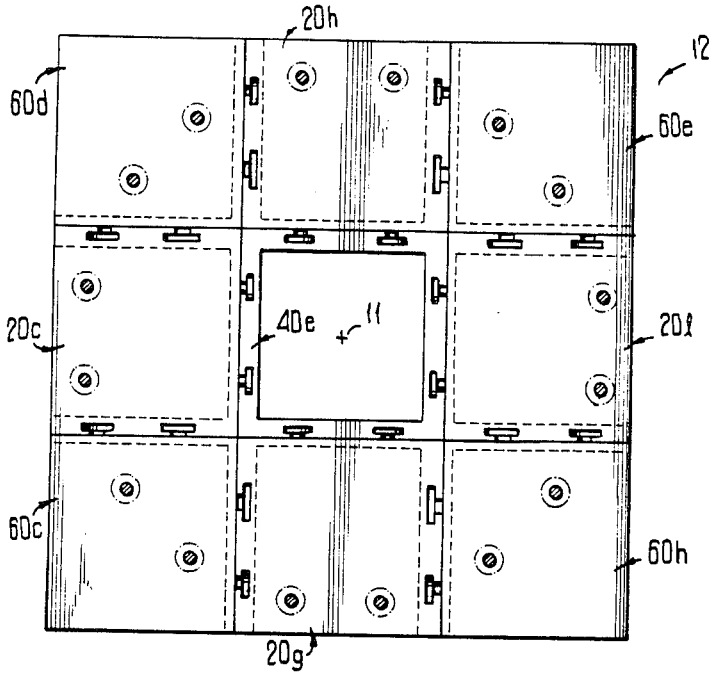
FIG. 16 is a cross-sectional view made by a plane cut at line 16—16 in FIG. 12.

Further details of the construction for the entire cubic lattice puzzle 12 are shown in FIG. 16, which is a cross-section of the cubic lattice puzzle 12 in FIG. 12 taken at a cut line 16—16. The cut line cuts away the corner components and edge components adjacent to the center component 40*e*. The resulting cross-section shows the alignment of the flange-shaped studs in these adjacent corner and edge components to form a circular path.

Figure 17:
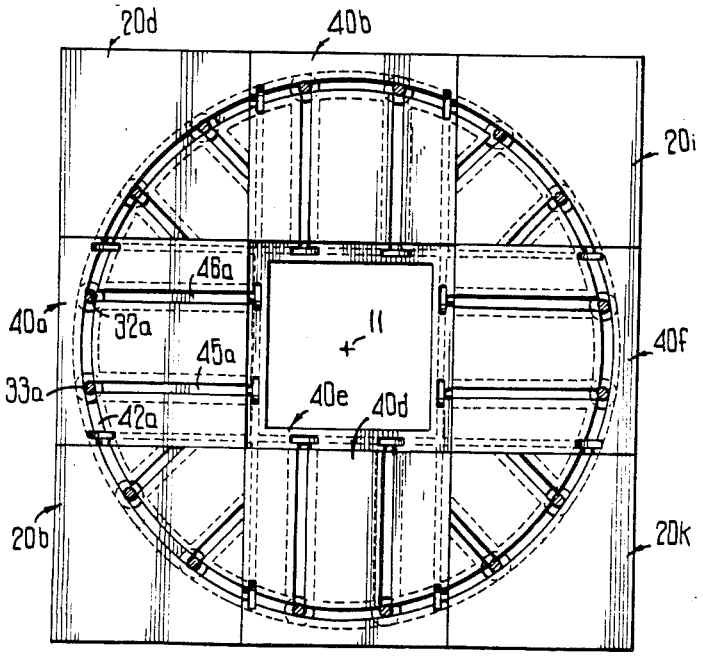
FIG. 17 is a cross-sectional view made by a plane cut at line 17—17 in FIG. 12.

FIG. 17 is a cross-sectional view formed by cutting the cubic lattice puzzle 12 of FIG. 12 at the cut line 17—17 and depicts adjacent center and edge components deployed about the void puzzle center. This view also shows the alignment of the various guiding tracks in these adjacent center and edge components to form a circular path.

The flange-shaped studs and guiding tracks at corresponding locations in the cubic solid puzzle 13 and the cubic mixed puzzle 14 have the same appearance as those shown in FIGS. 16 and 17.

In addition to the guiding tracks which are provided to guide the movement of adjacent components during normal operation of the puzzle, various assembly tracks are also provided to facilitate the assembly of the puzzle. Each parallel side 21*a* and 21*b* of each edge component has two such assembly tracks. With reference to FIGS. 8 and 9, assembly tracks 25*a* and 26*a* are shown for side 21*a* and assembly tracks 25*b* and 26*b* are shown for side 21*b*. The two assembly tracks for each side are parallel and spaced a distance apart equal to the distance between the flange-shaped studs, 62*a* and 63*a* for example, of an adjacent corner component. The assembly tracks open a channel from the operation guiding track to the edge of the component so that the flange-shaped studs of adjacent edge components may slide and pass into the operation guiding tracks during assembly. Each assembly track is parallel and equidistant to a plane extending from the center 11 of the rings and bisecting the arc of the operation guiding track to which the assembly tracks are connected.

Each side of each center component is also furnished with two assembly tracks, constructed in a manner similar to those provided in the edge components. With reference to FIGS. 10 and 11, assembly tracks 45*a* and 46*a* are shown for side 41*a* of the center component 40*a*. Similar assembly tracks 45*b*, 46*b*, 45*c*, 46*c*, 45*d*, and 46*d* are also provided for the remaining sides of the center component 40*a*. These assembly tracks open a channel from the operation guiding tracks of the center components to the edge of those components so that the flange-shaped studs of adjacent corner and edge components may slide and pass into the operation guiding tracks during assembly. Each assembly track is parallel and equidistant to a plane extending from the center 11 of the rings and bisecting the arc of the operation guiding track to which the assembly tracks are connected.

Figure 18:
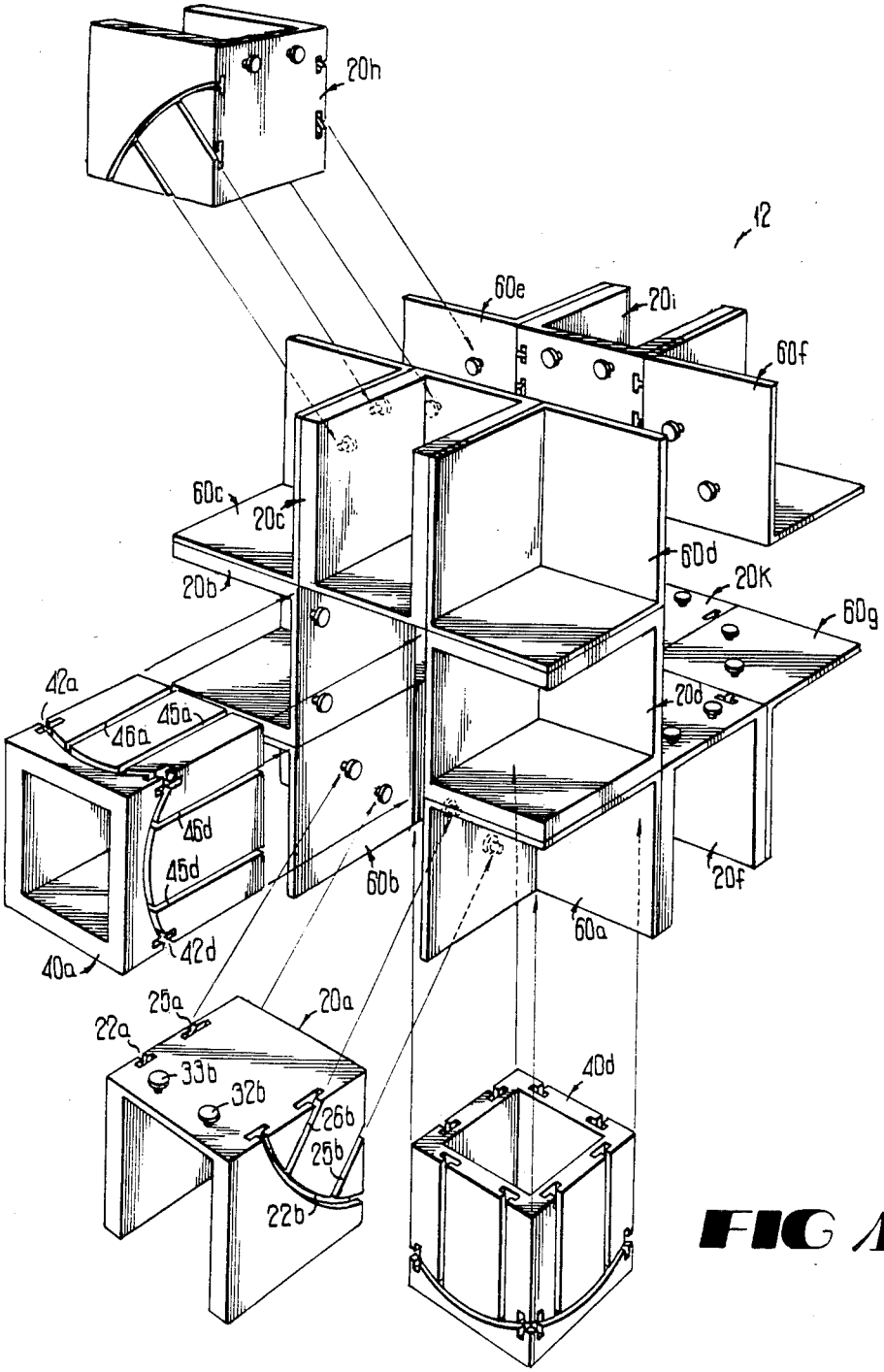
FIG. 18 is a partially exploded view of the embodiment in FIG. 12, showing the details of assembly.

The assembly of the puzzle can best be understood by reference to an assembly of the cubic lattice puzzle 12, as shown in FIG. 18. First, the eight corner components 60*a*, . . . , 60*h* of the puzzle are arranged and oriented so as to be in the final locations and orientations they will assume once the puzzle is assembled, i.e., at the corners of the overall cubic lattice. Next, each edge component is positioned in turn so that the assembly tracks engage the flange-shaped studs of two adjacent corner components. For example, edge component 20*a* is positioned so that its assembly tracks engage the studs protruding from corner components 60*a* and 60*b*. The edge component is then slid so that all four flange-shaped studs of the adjacent corner components are passed along the assembly tracks and into the operation guiding track.

When all twelve edge components have been thusly joined, each with two adjacent corner componets, the puzzle components are inseparable during normal operation and the puzzle may be operated without the addition of the center components. If the center components are desired in the final structure, one or more of these can be added by positioning each desired center component so that the assembly tracks engage all eight flange-shaped studs of the adjacent edge components. For example, center component 40*a* is positioned so that its assembly tracks engage the studs protruding from edge components 20*a*, 20*b*, 20*c*, and 20*d*. Each center component so positioned is then is slid into the puzzle until the studs engage the operation guiding track.

In an alternative assembly, from one to eight of the corner components may be left out of the puzzle. To begin this assembly, the corner components, if any, are placed at the desired corner locations. Next, all of the edge components are placed at edge component locations or are assembled with adjacent corner components, if any. Finally, all of the center components are assembled into the puzzle as previously described. Once all center components have engaged the studs of all of the edge components, the puzzle components so assembled are inseparable during normal operation and the puzzle is fully operational and may be operated, even if there are no corner components.

The ring puzzle 10 is assembled in an analogous fashion. It can be appreciated that the ring puzzle can also be operated either without all or any particular group of the cener components as long as all corner and edge components are properly assembled, or without all or any particular group of the corner components as long as all edge and center components are properly assembled.

Figure 2:
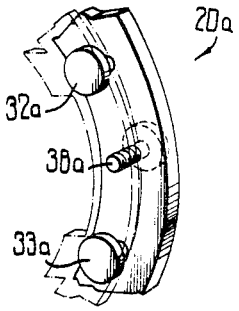
FIG. 2 is an perspective detail view showing the studs and screws employed in the embodiment of the puzzle in FIG. 1.
Figure 3:
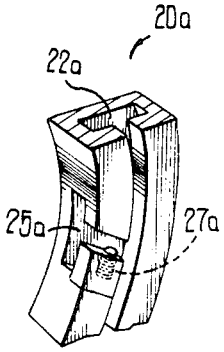
FIG. 3 is an perspective detail view showing the channels employed in the embodiment of the puzzle in FIG. 1.

Finally, locking means are provided in the preferred embodiment to ensure that the components, once assembled, will not inadvertently disassemble during operation of the puzzle. In the ring puzzle 10, set screws, for example set screw 38*a* shown in FIGS. 1, 2 and 5, are provided which screw into tapped holes, for example tapped hole 37*a* shown in FIG. 9, and extend into the guiding track of the adjacent components as shown in FIG. 5. During operation of the puzzle, the set screws keep the studs from passing into the assembly channels. The set screws may be removed for disassembly and assembly of the puzzle.

As an alternative locking arrangement, a ball actuated by a spring can close, for example, assembly track 25*a*. Similar springactuated balls close off the other assembly tracks. With the urging of the spring, the ball closes the assembly track and prohibits the studs from entering the assembly track. However, with appropriate pressure on the components, the spring will compress and the ball will move to permit passage of a stud into the assembly track for disassembly or assembly of the puzzle.

Figure 15:
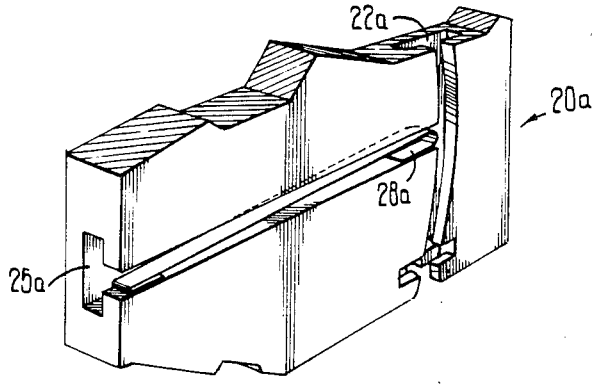
FIG. 15 is an perspective detail view showing the leaf-spring which closes the assembly channel.

In the cubic variations of the puzzle, an alternative locking mechanism is a leaf-spring 28*a* added in the assembly track as depicted in FIG. 15. The leaf-spring normally blocks entry into the assembly track, but appropriate pressure on a component will cause the leaf to depress and allow entry into the assembly track.

Figure 19:
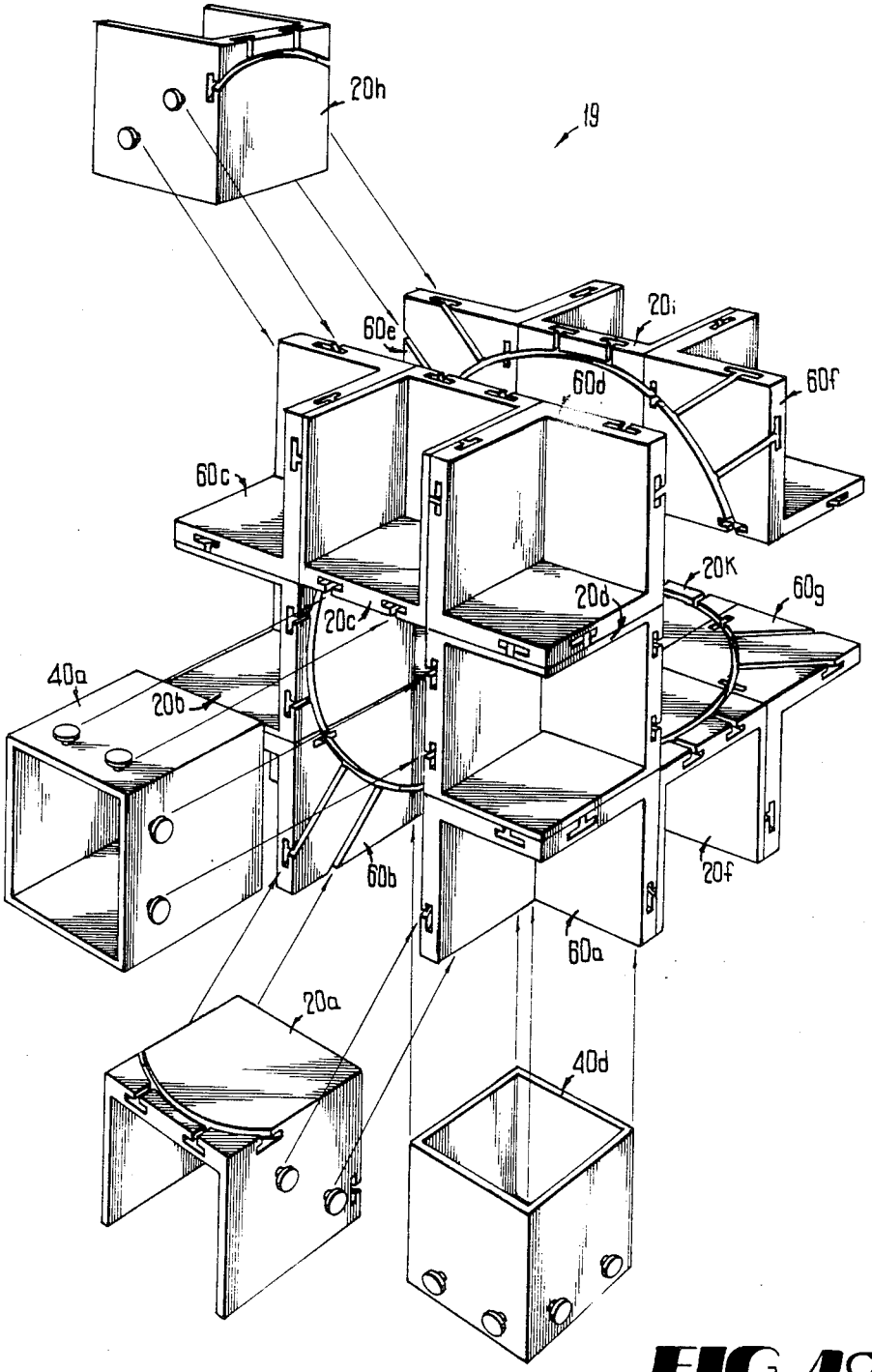
FIG. 19 is a partially exploded view of a cubic lattice embodiment wherein the channels and the studs are interchanged with respect to the embodiment shown in FIG. 18.

Further of interest, it is noted that there is symmetry between the guiding tracks and track-engaging means, and these may be interchanged in the various components of the various embodiments of the puzzle, as is depicted for example in the alternate cubic lattice puzzle 19 in FIG. 19. As shown in FIG. 19, the operation guiding tracks and track-engaging studs are located along the same circular paths as those of the cubic lattice puzzle 12 and as shown, for example, in FIG. 17. However, the tracks and studs are inter-changed. In addition, since the assembly tracks must provide for passage of the track-engaging studs during assembly of the puzzle, they must exit the component in directions opposite to the directions provided in the cubic lattice puzzle 12 and shown, for example, in FIG. 18. The locking mechanism of alternate cubic lattice puzzle 19 is the same as for other embodiments, i.e., a spring-actuated ball or a leaf-spring, as desired to facilitate construction of the puzzle components.

Rather than construct the puzzle components with assembly tracks and locking mechanisms, the flange-shaped studs or other track-engaging means may be constructed of a resilient deformable material, such as plastic. The deformable material should be of a nature which permits each component to be snapped into place, with the track-engaging means, for example, the flange of a stud, deforming as its passes into an operation guiding track, and elastically returning to its original shape so as to hold the component in position. Once the components are in place, the deformable studs or other means should slide within the operation guiding tracks to permit rotation of the components as has been previously described.

Finally, it will be understood that the preferred embodiments of the present invention have been disclosed by way of example, and that other modifications may occur to those skilled in the art without departing from the scope and spirit of the appended claims.

What is claimed is:

1. A puzzle comprising:

(a) a plurality of edge components wherein each such edge component has two orthogonal faces and two parallel faces, with each such parallel face being perpendicular to both of the orthogonal faces;

(b) a plurality of center components wherein each such center component has two pair of parallel faces, with each pair perpendicular to the other pair;

(c) a separate operation guiding track associated with each parallel face of each edge component, for guiding the movement of adjacent orthogonal faces of other edge components during operation of the puzzle;

(d) a separate operation guiding track associated with each parallel face of each center component, for guiding the movement of adjacent orthogonal faces of edge components during operation of the puzzle;

(e) a separate track engagement means associated with each orthogonal face of each edge component, for engaging and following the guiding tracks of adjacent parallel faces of center components and other edge components; and (f) a separate assembly guiding track associated with each face of each center component, each with locking means to selectively permit passage of the adjacent edge component track engagement means along the assembly guiding track only during assembly of the puzzle.

2. The puzzle of claim 1 wherein the operation guiding tracks describe semi-circular arcs of a common radius of curvature.

3. The puzzle of claim 2 wherein each said assembly guiding track associated with each face of each center component describes a straight line in the plane of each said face and provides a passage from the operation guiding track associated with each said face to the edge of each said face interior to the arc of each said associated operation guiding track, so that by passing each track engagement means associated with each adjacent edge component perpendicular face along the adjacent one of said passages, each center component may be assembled into the puzzle slidably along said adjacent edge component perpendicular faces in a direction precisely toward the puzzle center.

4. A puzzle comprising:

(a) a plurality of edge components wherein each such edge component has two orthogonal faces and two parallel faces, with each such parallel face being perpendicular to both of the orthogonal faces;

(b) a plurality of corner components wherein each such corner component has three mutually orthogonal faces;

(c) a separate operation guiding track associated with each parallel face of each edge component, for guiding the movement of adjacent orthogonal faces of corner and other edge components during operation of the puzzle;

(d) a separate track engagement means associated with each orthogonal face of each edge component, for engaging and following the guiding tracks of adjacent parallel faces of other edge components;

(e) a separate track engagement means associated with each face of each corner component, for engaging and following the guiding tracks of adjacent parallel faces of edge components; and (f) a separate assembly guiding track associated with each parallel face of each edge component, each with locking means to selectively permit passage of the adjacent corner component track engagement means along the assembly guiding track only during assembly of the puzzle.

5. The puzzle of claim 4 wherein the operation guiding tracks describe semi-circular arcs of a common radius of curvature.

6. The puzzle of claim 5 wherein each said assembly guiding track associated with each parallel face of each edge component describes a straight line in the plane of each said parallel face and provides a passage from the operation guiding track associated with each said parallel face to the edge of each said parallel face interior to the arc of each said associated operation guiding track, so that by passing each track engagement means associated with each adjacent corner component face along the adjacent one of said passages, each edge component may be assembled into the puzzle slidably along said adjacent corner component faces in a direction generally toward the puzzle center.

7. A puzzle comprising:

(a) a plurality of edge components wherein each such edge component has two orthogonal faces and two parallel faces, with each such parallel face being perpendicular to both of the orthogonal faces;

(b) a plurality of center components wherein each such center component has two pair of parallel faces, with each pair perpendicular to the other pair;

(c) a separate operation guiding track associated with each orthogonal face of each edge component, for guiding the movement of adjacent parallel faces of center components and other edge components;

(d) a separate track engagement means associated with each parallel face of each edge component, for engaging and following the guiding tracks of adjacent orthogonal faces of other edge components during operation of the puzzle;

(e) a separate track engagement means associated with each parallel face of each center component, for engaging and following the guiding tracks of adjacent orthogonal faces of edge components during operation of the puzzle; and (f) a separate assembly guiding track associated with each perpendicular face of each edge component, each with locking means to selectively permit passage of the adjacent center component track engagement means along the assembly guiding track only during assembly of the puzzle.

8. The puzzle of claim 7 wherein the operation guiding tracks describe semi-circular arcs of a common radius of curvature.

9. The puzzle of claim 8 wherein each said assembly guiding track associated with each perpendicular face of each edge component describes a straight line in the plane of each said perpendicular face and provides a passage from the operation guiding track associated with each said perpendicular face to the edge of said perpendicular face exterior to the arc of each said associated operation guiding track, so that by passing each track engagement means associated with each adjacent center component face along the adjacent one of said passages, each center component may be assembled into the puzzle slidably along said adjacent edge component perpendicular faces in a direction precisely toward the puzzle center.

10. A puzzle comprising:

(a) a plurality of edge components wherein each such edge component has two orthogonal faces and two parallel faces, with each such parallel face being perpendicular to both of the orthogonal faces;

(b) a plurality of corner components wherein each such corner component has three mutually orthogonal faces;

(c) a separate operation guiding track associated with each orthogonal face of each edge component, for guiding the movement of adjacent parallel faces of other edge components;

(d) a separate operation guiding track associated with each face of each corner component, for guiding the movement of adjacent parallel faces of edge components;

(e) a separate track engagement means associated with each parallel face of each edge component, for engaging and following the guiding track of adjacent orthogonal faces of corner and other edge components during operation of the puzzle; and (f) a separate assembly guiding track associated with each face of each corner component, each with locking means to selectively permit passage of the adjacent edge component track engagement means along the assembly guiding track only during assembly of the puzzle.

11. The puzzle of claim 10 wherein the operation guiding tracks describe semi-circular arcs of a common radius of curvature.

12. The puzzle of claim 11 wherein each said assembly guiding track associated with each face of each corner component describes a straight line in the plane of each said face and provides a passage from the operation guiding track associated with each said face to the edge of each said face exterior to the arc of each said associated operation guiding track, so that by passing each track engagement means associated with each adjacent edge component parallel face along the adjacent one of said passages, each edge component may be assembled into the puzzle slidably along said adjacent corner component faces in a direction generally toward the puzzle center.

* * * * *